United States Patent [19]

Fromknecht et al.

[11] 4,020,525

[45] May 3, 1977

[54] VACUUM CLEANER FILTER BAG CONDITION INDICATOR

[75] Inventors: Charles T. Fromknecht; Donald W. Carnes, both of Anderson, S.C.

[73] Assignee: The Singer Company, New York, N.Y.

[22] Filed: Aug. 13, 1975

[21] Appl. No.: 604,277

[52] U.S. Cl. ..... 15/339; 55/274; 55/DIG. 34; 116/114 AD

[51] Int. Cl.[2] ..... A47L 9/00

[58] Field of Search ..... 15/339; 55/274, DIG. 34; 116/114 AD

[56] References Cited

UNITED STATES PATENTS

| | | | |
|---|---|---|---|
| 2,325,188 | 7/1943 | Lofgren | 116/114 AD X |
| 2,750,915 | 6/1956 | Carlberg | 116/114 AD X |
| 2,815,733 | 12/1957 | Rykert | 116/114 AD |
| 2,954,751 | 10/1960 | Barnes, Jr. | 55/DIG. 34 |
| 3,183,882 | 5/1965 | Preece | 55/DIG. 34 |

*Primary Examiner*—Christopher K. Moore
*Attorney, Agent, or Firm*—Edward L. Bell; Robert E. Smith; Alan Ruderman

[57] ABSTRACT

A vacuum cleaner filter bag condition indicator that detects when the bag is substantially full and should be replaced. The indicator includes a pressure responsive member having internal filter bag pressure applied to a small area of one side thereof and filter bag compartment pressure applied to the entire other side. When the bag becomes substantially full the bag pressure increases and the increased pressure differential causes the pressure responsive member to move slightly to allow the filter bag pressure to act on the entire area of the one side. The pressure responsive means thereafter quickly moves toward the lower pressure side and forces an indicator button out the cleaner.

7 Claims, 4 Drawing Figures

VACUUM CLEANER FILTER BAG CONDITION INDICATOR

BACKGROUND OF THE INVENTION

This invention rrelates to vacuum cleaners and more particularly to an indicator for detecting when the dirt collecting filter bag is substantially full and should be replaced.

During the operation of a vacuum cleaner, dirt laden air is drawn into the cleaner inlet, directed through a dirt collecting filter bag and clean filtered air is exhausted through an outlet. The added friction due to the dirt that collects in the bag results in a reduction in the air flowing through the cleaner and an increase in the pressure drop through the bag. When the pressure drop reaches a predetermined amount, the bag has separated and collected all that it practicably should. Thereafter, continued operation with the same bag will cause so great a pressure drop that the air flow and suction does not provide good cleaning. Moreover, increased power is required to drive the cleaner motor-blower with a substantially full bag. Another effect of operating with the bag in such condition is that most canister vacuum cleaner motor blowers are of the direct flow type whereby the filtered air is thereafter used to cool the motor. When the air flow drops the temperature of the motor increases and can eventually destroy the motor.

This problem has been recognized and many attempts at a solution have been made. Cawl U.S. Pat. No. 2,741,328; Forsberg U.S. Pat. No. 2,192,224; Martinet U.S. Pat. No. 2,203,171; and Sellers U.S. Pat. No. 2,117,368 are indicative of some of the approaches in indicating when the bag is substantially full.

SUMMARY OF THE INVENTION

The present invention provides an inexpensive and practical indicator having a button that rapidly "pops" out of the cleaner when the bag should be replaced. The indicator button remains in until the pressure differential across the dirt collecting filter bag exceeds the given predetermined pressure and thereafter the button extends fully from the cleaner. The indicator of the present invention comprises a pressure responsive member such as a diaphragm or piston preferably encased in a housing ported to the inlet and hence the filter bag of a cleaner so that the filter bag communicates with a chamber in the casing having a wall including an orifice against which the front face of the pressure responsive member is seated. The rear face of the pressure responsive member communicates through a port to the filter bag chamber. A compression spring preferably acting against the rear face of the pressure responsive member urges the member against the seating wall. An indicator button or the like is secured to a rod attached to the rear face of the member and is adapted to extend outwardly from the cleaner body. The orifice in the wall against which the front face of the member seats is small relative to the face of the member. When the bag becomes full the pressure differential across the filter bag moves the member slightly to allow air to bleed past the seal between the member face and the wall. When this occurs the pressure in the filter bag thereafter acts on the entire front face of the member thereby rapidly forcing the button completely out of the cleaner body. The force on the pressure responsive member is therefore in effect amplified in accordance with the ratio of the area of the member to the area of the orifice in the wall. No intermediate indicator position is created. The button is either fully out or fully in. The operator is thus alerted that the filter bag is full and should be changed.

Accordingly it is a primary object of the present invention to provide a filter bag condition indicator for a vacuum cleaner that detects when the filter bag is effectively full and should be replaced.

It Is another object of the present invention to provide a filter bag condition indicator for a vacuum cleaner that is functionally effective, but inexpensive to manufacture.

A further object of this invention is to provide a full bag indicator for a vacuum cleaner in which a pressure signal is amplified so as to positively indicate when the bag is substantially full, and when the bag is usable, but does not indicate any intermediate partial condition.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENTS

Figure 1:
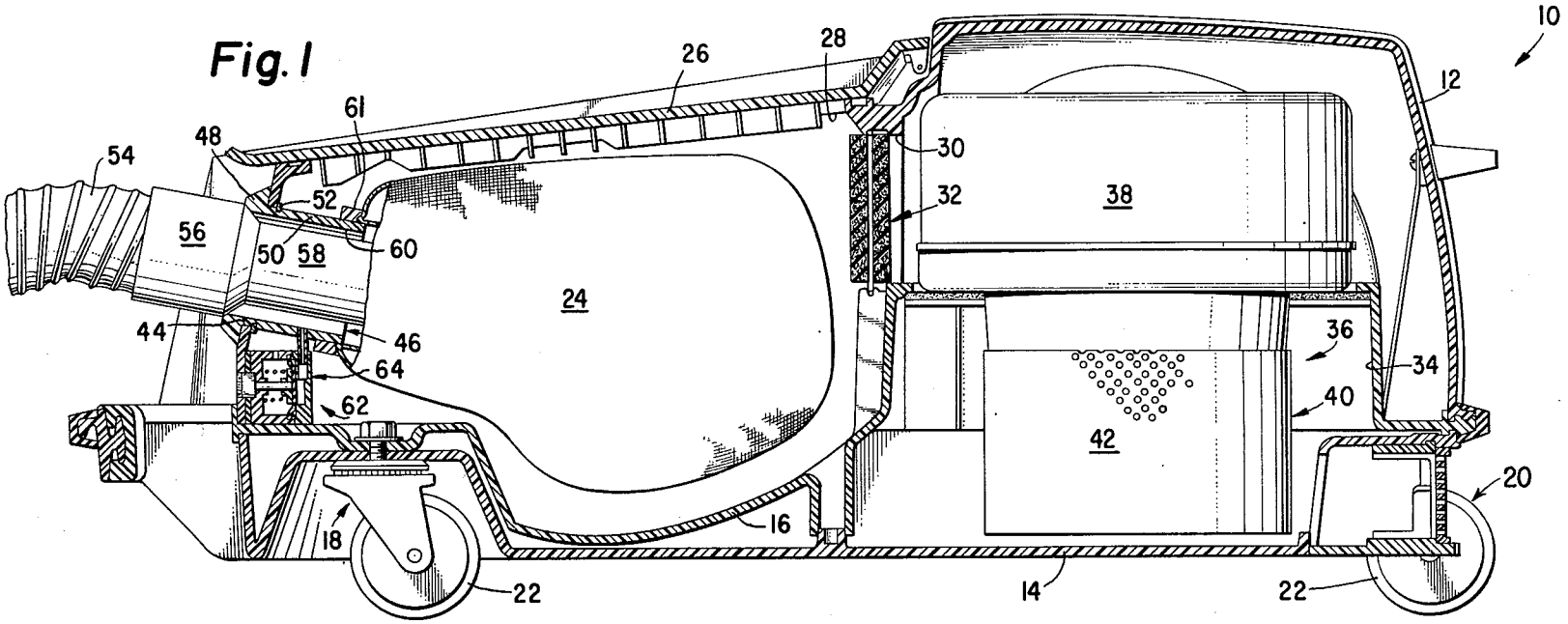
FIG. 1 is a vertical sectional view taken substantially along the longitudinal center line of a vacuum cleaner embodying the indicator of the present invention.

Referring now to the accompanying drawings wherein like reference numerals denote similar parts throughout the several views, there is disclosed a canister vacuum cleaner 10 comprising a frame having an upper housing 12, a lower housing 14, and a bulkhead or intermediate housing 16 trapped between the upper and lower housings in sandwich-like relationship. The three housings are fitted together and secured by conventional means. Front and rear wheel assemblies 18 and 20 which includes wheels 22 to allow manipulation of the cleaner aid in securing the lower housing 14 to the bulkhead 16. For a more thorough description of the cleaner, reference may be made to Batson, et.al., U.S. Pat. No. 3,668,842 assigned to the assignee of the present application.

A vacuum compartment within which is located a porous air permeable filter bag 24 is formed by the walls of the bulkhead 16, the upper housing 12 and a plastic molded filter bag access door 26 which is fitted over a recessed opening 28 in the upper housing. The door may be shut and latched to provide a substantially air-tight seal for the vacuum compartment. Mounted in the vacuum or filter bag compartment in front of a pair of openings 30 formed in a partition wall (not shown) is a washable permanent secondary filter 32 described in Batson, et.al. U.S. Pat. No. 3,636,681 assigned to the assignee of the instant application. The bulkhead 16 is formed at the rear thereof with a molded pocket 34 within which is mounted a motor-blower assembly 36 which may be of any suitable standard construction.

The air moving or motor-blower assembly 36 preferably comprises a two stage fan unit 38 and a co-axial driving motor unit 40, the motor being cooled by the filtered air flow drawn through the cleaner by the fans. The air enters an inlet opening (not shown) in the top of the fan unit casing and is exhausted at the motor end through a cylindrically shaped motor-blower guard 42 that is formed with exhaust apertures (only some of which are illustrated) in the cylindrical wall and is secured to the motor frame by means, for example, of screws (not shown).

Formed in the front wall of the upper housing is a central opening 44 within which is inserted an intake connector 46 having a flange portion 48 and a cylindrical extension 50. The connector is secured in the upper housing by means of its front flange portion 48 and an annular retaining ring 52 which together lock the connector axially to the upper housing. A hose 54 fitted with a coupling 56 having an adaptor 58 at its other end is connected into a frontal opening 60 of the connector 46. The disposable filter bag 24 includes a mounting collar 61 which slips onto the cylindrical extension 50 of the connector 46 and is held thereon by friction so that the dirt and dust in the inlet air stream passing through the hose 54 remains in the bag as the air is drawn through the vacuum or filter bag compartment by the motor-blower assembly.

Figure 2:
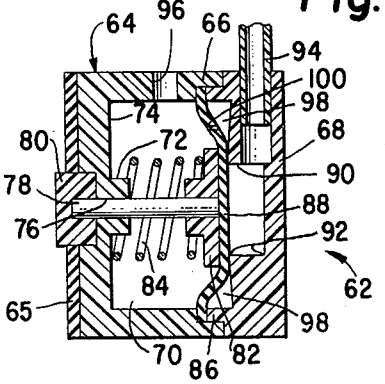
FIG. 2 is an enlarged view of the indicator illustrated in FIG. 1 in the normal position with an effective filter bag, prior to detection of a full bag condition.

In accordance with the preferred embodiment of the present invention an indicator assembly 62, as best illustrated in FIG. 2, is provided for detecting when the filter bag 24 is substantially full and should be replaced. The indicator assembly preferably comprises a casing 64 mounted on the bulkhead 16 within the front wall of the upper housing. A seal 65 on the casing may be provided to prevent leakage of air past the indicator from the bag compartment. The casing 64 may be of any convenient shape and preferably may be constructed of a main housing 66 and a cover 68 secured thereto. The interior of the housing 66 is in the form of a hollow cavity 70 and includes a boss 72 formed on the interior of the wall 74 opposite the cover 68. A hole 76 is formed in the wall 74 centrally of the boss for receiving a rod 78. Secured on the front end of the rod 78 outside the cavity 70 is an indicator member 80 which may be in the form of a red colored button. A disk-like member 82 is secured to the other end of the rod within the cavity 70 and a coil spring 84 preferably of the compression type is positioned on the rod between the boss 72 and the disk member 82. Peripherally fixed within the interior of the casing, preferably in a groove formed between the housing 66 and an annular portion 86 of the cover 68 is a resilient diaphragm 88 which is engaged against, and preferably fixed to, the disk member 82 and effectively partitions the casing into two chambers.

Recessed from the annular portion 86 of the cover 68 is an annular walll 90 which is preferably radially tapered from a substantially central orifice 92 so as to provide an undercut portion remote from the orifice. The orifice 92 communicates through a tube 94 with the interior of the vacuum cleaner inlet preferably through the member 50 so that the pressure at the orifice is that of the air flowing through the inlet, which is substantially that within the filter bag. This pressure is therefore the pressure on the face on the diaphragm that engages the wall 90 and seals the orifice. On the other hand, the interior of the cavity 70 on the spring side of the diaphragm is vented by a port 96 to the vacuum or filter bag compartment, and is therefore at the pressure surrounding the bag. Thus, the pressure differential across the diaphragm in the vicinity of the orifice is the same as that of the pressure drop of the air through the bag. Moreover, the forces on the diaphragm comprise the pressure in the filter bag multiplied by the area of the diaphragm sealing the orifice on the one side, and the pressure in the vacuum compartment multiplied by the total area of the diaphragm plus the spring force on the other side.

Figure 3:
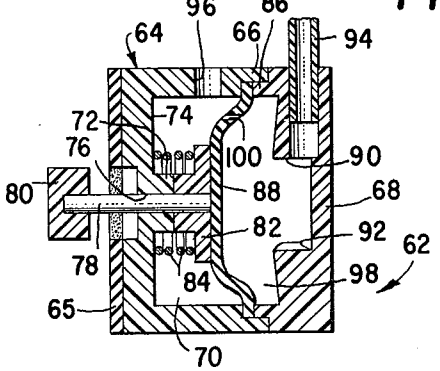
FIG. 3 is a view similar to that of FIG. 2 but illustrating the indicator after receiving a full filter bag signal.

As the amount of dirt in the bag increases the pressure drop through the bag likewise increases. At some point the amount of dirt in the bag is such that the efficiency of the cleaner drops substantially and the temperature increase across the motor due to a loss of cooling air flow is such that the bag should be replaced. The spring 84 is designed such that when this condition occurs the pressure differential across the diaphragm is such that the force on the small area of the diaphragm sealing the orifice is greater than the force on the other side so as to compress the spring slightly and thereby allow the diaphragm to move slightly and unseal the orifice. At this point the pressure in the orifice 92 bleeds past the wall 90 and enters the undercut annulus 98. The pressure in the orifice thereafter acts on the entire area of the diaphragm 88 to create a large unbalance of the forces across the diaphragm and effects a rapid and substantially full compression of the spring. Until this time the pressure in the filter bag only acts on the small area of the diaphragm seated against the orifice. The rod 78, and thus the indicator 80, is thereby rapidly forced out of the front of the casing as illustrated in FIG. 3, and is clearly visible to the operator who thereafter should shut the cleaner and change the bag. An amplification effect, determined by the area ratio of the entire diaphragm to the area of the orifice, provides a quick and rapid extension of the indicator at the critical movement. An intermediate, partly exposed, indicator position is never seen by the operator so confusion as to when to change the bag is avoided.

A small bleed hole 100 is provided in the diaphragm to insure that if a poor seal exists between the diaphragm and the wall 90 the air in the annulus 98 can escape behind the diaphragm and balance the pressure rather than actuating the indicator prematurely. It also acts to prevent premature actuation when the cleaner starts up from rest.

Figure 4:
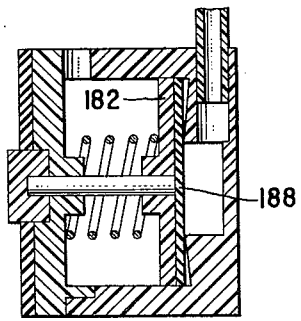
FIG. 4 is a view similar to FIG. 2 but illustrating a second embodiment of the invention.

A second embodiment of the invention is illustrated in FIG. 4 which is similar to the embodiment of FIGS. 2 and 3. However, in this embodiment instead of a resilient diaphragm, a piston 182 is provided. The piston extends across the interior of the casing and preferably includes a gasket or seal 188 for closing the orifice and preventing leakage until the pressure differential across the piston causes the spring to compress slightly. A bleed hole was not found necessary in this embodiment since there apparently is some normal leakage past the seal 188. The operation of this embodiment is the same as that of the first embodiment in all other respects.

Numerous alterations of the structure herein disclosed will suggest themselves to those skilled in the art. However, it is to be understood that the present disclosure relates to preferred embodiments of the invention which is for purposes of illustration only and not to be construed s a limitation of the invention. All such modifications which do not depart from the spirit of the invention are intended to be included within the scope of the appended claims.

Having thus described the nature of the invention, what we claim herein is:

1. In a vacuum cleaner having a housing including a suction compartment, an air permeable filter bag mounted in said compartment, means defining an air inlet in said housing communicating with said filter bag, means defining an outlet in said housing, an air-moving unit in flow communication with said compartment and said outlet for drawing dirt-laden air through said inlet and discharging filtered air through the outlet, the improvement comprising: indicator means for detecting a pressure drop of predetermined amount through said filter bag thereby to indicate that the filter bag is substantially full of dirt, said indicator means comprising a casing mounted in the housing, pressure responsive means including a movable partition member mounted in said casing and separating said casing into first and second chambers, means communicating said suction compartment with the first chamber, said second chamber including a wall having an orifice, said orifice being smaller than said partition member, means communicating said filter bag with said orifice, means for urging said partition member against said wall to normally seal said orifice until said predetermined pressure drop is reached, bleed means for balancing the pressure across the partition member adjacent the wall about the orifice until said predetermined pressure drop is reached, and an indicator associated with said pressure responsive means extending from said casing, whereby the partition member unseats and the indicator is rapidly forced out the casing when the pressure in the filter bag is greater by said predetermined amount than the pressure in the compartment.

2. In a vacuum cleaner as recited in claim 1 wherein said pressure responsive means comprises a rod mounted in said casing for axial movement, means for connecting said rod to said partition member, said means for urging comprising spring means for biasing said rod and partition member against said wall until overcome by the pressure in the orifice.

3. In a vacuum cleaner as recited in claim 2 wherein said partition member comprises a resilient diaphragm positioned across the casing intermediate said first and second chambers and normally urged to close the orifice from communicating with the remainder of the second chamber.

4. In a vacuum cleaner as recited in claim 3 wherein said bleed means comprises a bleed hole in said diaphragm remote from the orifice closing portion of the diaphragm.

5. In a vacuum cleaner as recited in claim 3 wherein said diaphragm is peripherally fixed in the casing, and said rod and biasing means are positioned substantially in the central portion of said diaphragm.

6. In a vacuum cleaner as recited in claim 2 wherein said partition member comprises a piston sized to reciprocate in the first chamber.

7. In a vacuum cleaner as recited in claim 2 wherein said wall is undercut to provide an annular space between said partition member and said waall when the partition member is seated against the orifice.

* * * * *